US006499380B1

(12) United States Patent
Hsiao

(10) Patent No.: US 6,499,380 B1
(45) Date of Patent: Dec. 31, 2002

(54) REVERSIBLE RATCHET WRENCH

(76) Inventor: Ching Jih Hsiao, No. 1, Alley 16, Lane 40, Jinn Te Road, Taichung (TW)

( * ) Notice: Subject to any disclaimer, the term of this patent is extended or adjusted under 35 U.S.C. 154(b) by 0 days.

(21) Appl. No.: 09/941,208

(22) Filed: Aug. 29, 2001

(51) Int. Cl.[7] ..... B25B 13/46
(52) U.S. Cl. ..... 81/63.2; 81/63
(58) Field of Search ..... 81/60, 61, 62, 81/63, 63.1, 63.2

(56) References Cited

U.S. PATENT DOCUMENTS 3,044,591 A * 7/1962 Kilness ..... 81/63.2
3,606,940 A * 9/1971 Finkeldei ..... 81/63.2
3,677,102 A * 7/1972 Simonetta ..... 81/63
4,053,037 A * 10/1977 Solomon ..... 81/63
4,257,507 A * 3/1981 Solomon ..... 81/63
4,497,227 A * 2/1985 Stasiek ..... 81/63.2
5,495,783 A * 3/1996 Slusar et al. ..... 81/63.2
5,960,680 A * 10/1999 Chen et al. ..... 81/63.2
6,044,731 A * 4/2000 Hsieh ..... 81/63.2

* cited by examiner

*Primary Examiner*—Eileen P. Morgan
*Assistant Examiner*—Joni B. Danganan

(57) ABSTRACT

A reversible ratchet wrench includes a ring-shaped head with first teeth defined in an inner periphery thereof and an engaging ring is rotatably received in the head. A pawl is movably engaged with a surface defined in an outer periphery of the engaging ring and has second teeth for being engaged with the first teeth in the head. A control disk is connected to the pawl and rotatably located on a second surface of the head. A fixing ring is engaged with a neck extending from the engaging ring to position the control disk in position. The pawl is shifted by rotating the control disk.

1 Claim, 6 Drawing Sheets

REVERSIBLE RATCHET WRENCH

FIELD OF THE INVENTION

The present invention relates to a reversible ratchet wrench which has a engaging ring received in the head of the tool and a pawl located on an outer periphery of the engaging ring and plural teeth of the pawl are engaged with the teeth in the inside of the head.

BACKGROUND OF THE INVENTION

A conventional reversible ratchet wrench known to applicant is disclosed in U.S. Pat. No. 5,568,751 with the title of "reversible ratchet wrench and reversible ratchet mechanism thereof" to Lee. The patent '751 discloses a ring member in which a pawl is pivotally engaged with an inner periphery thereof so as to be engaged with the teeth defined in an inner periphery of the head of the tool. An inherent shortcoming of this type of mechanism is that only few teeth are used to engage with the teeth of the head so that when an large torque output is applied, the few teeth cannot afford it and the tool could be damaged.

Another reversible ratchet wrench known to applicant is disclosed in U.S. Pat. No. 5,916,339 with a title of "one-way drive mechanism and corresponding ratchet tool" to Dumont. Although the pawl of the wrench disclosed in patent '339 has plural teeth to be engaged with the teeth of the head, the member received in the head is a solid member so that only an engaging rod extends from the member in the head to be engaged with sockets or the like. In other words, the member in the head is not a ring-like member so that the sockets or the objects have to be connected to the engaging rod and this prolongs the length from the head to the object to be rotated.

Yet another reversible ratchet wrench known to applicant is disclosed in U.S. Pat. No. 6,044,731 with a title of "double-reversible ratchet wrench" to Hsieh. The wrench disclosed in patent '731 has a recess defined in an inner periphery of the head of the tool so as to receive a pawl therein and the ring member in the head has outer teeth for being engaged with the pawl. This type of wrench has a large head so that there is a space for receiving the pawl. The large head is not convenient for insertion of the head in a narrow space to rotate an object.

SUMMARY OF THE INVENTION

In accordance with one aspect of the present invention, there is provided a reversible ratchet wrench which comprises a ring-shaped head with first teeth defined in an inner periphery of the head and an engaging ring is rotatable received in the head. A surface is defined in an outer periphery of the engaging ring for a pawl to be engaged therewith. A neck extends from a first end of the engaging ring and a flange extends radially outward from a second end of the engaging ring so as to engage a first surface of the head. The pawl has second teeth which are engaged with the first teeth in the head. A control disk is connected to the pawl and rotatably located on a second surface of the head. A fixing ring is engaged with the neck of the engaging ring.

The primary object of the present invention is to provide a reversible ratchet tool that has a ring-shaped head and plural teeth are engaged between the head and the pawl.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
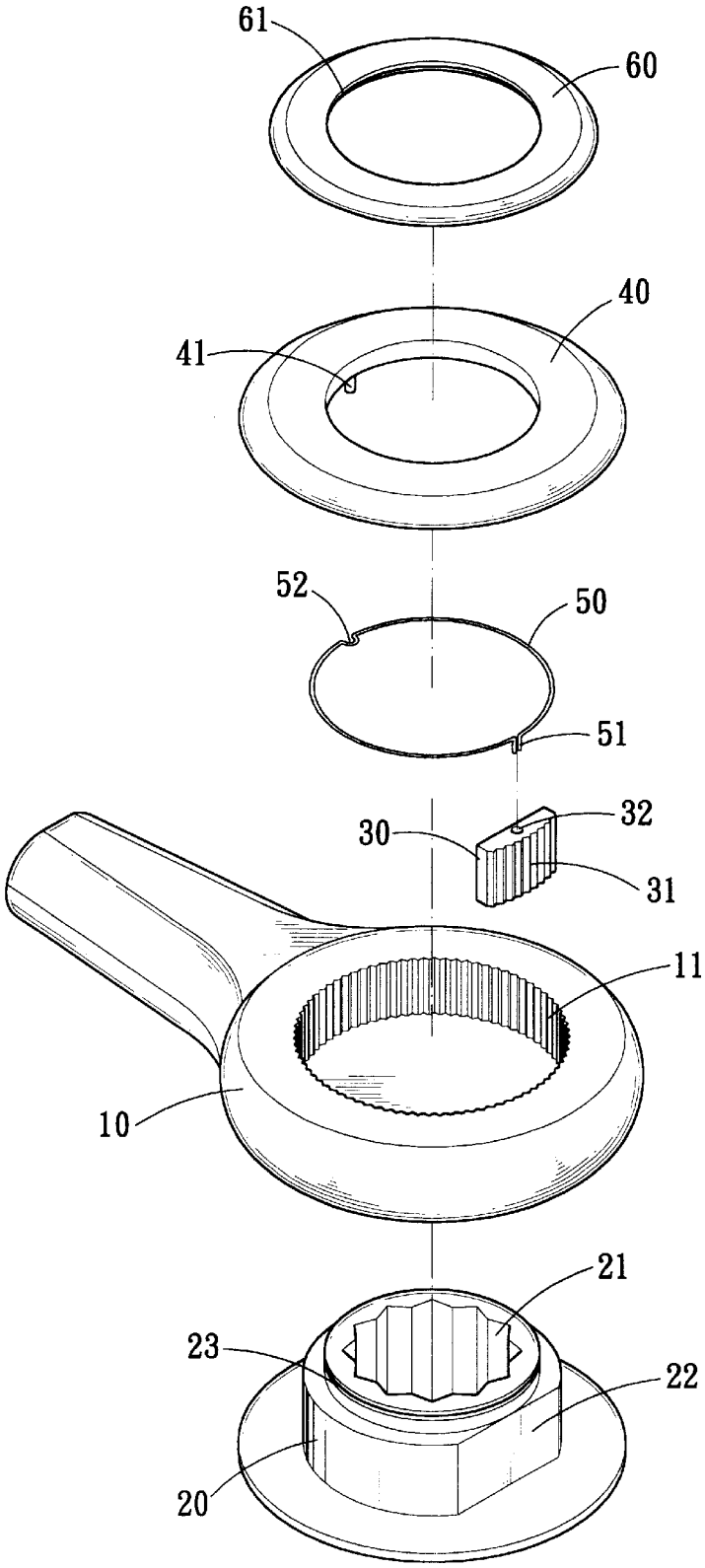
FIG. 1 is an exploded view to show a reversible ratchet wrench of the present invention.
Figure 2:
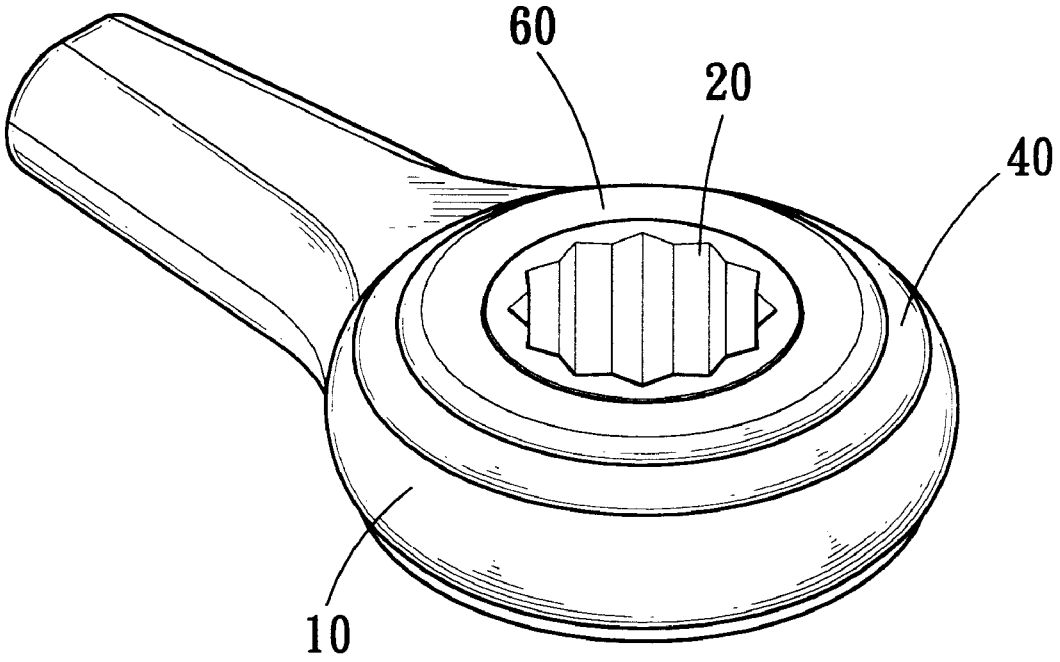
FIG. 2 is a perspective view to show the reversible ratchet wrench of the present invention.
Figure 3:
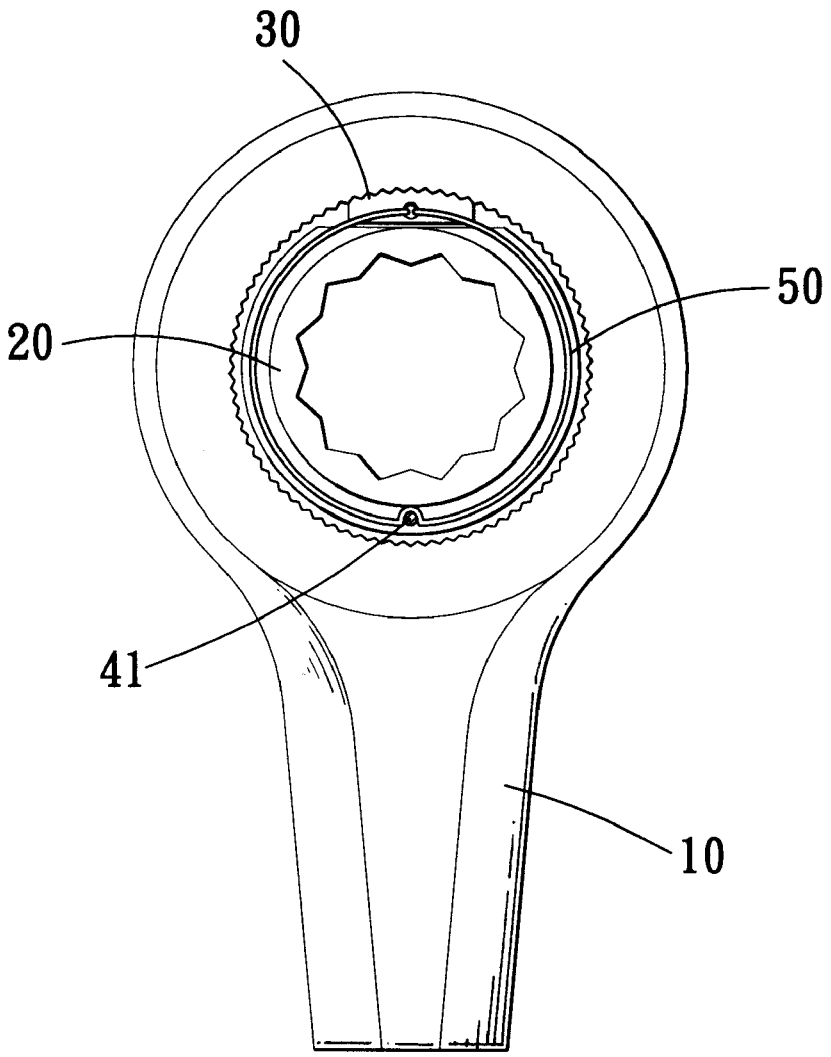
FIG. 3 is a top view to show reversible ratchet wrench of the present invention.

Referring to FIGS. 1 to 3, the ratchet wrench of the present invention comprises a ring-shaped head 10 with first teeth 11 defined in an inner periphery of the head 10 and a handle extends from the head 10. An engaging ring 20 is rotatably received in the head 10 and a surface 22 is defined in an outer periphery of the engaging ring 20. A neck 23 with threads on an outer periphery thereof extends from a first end of the engaging ring 20 and a flange extends radially outward from a second end of the engaging ring 20 so as to engage a first surface of the head 10. A polygonal through hole 21 defined through the engaging ring 20 so that object can be engaged with the polygonal through hole 21.

A pawl 30 has a flat surface which is movably engaged with the surface 22 of the engaging ring 20 and second teeth 31 are defined in the pawl 30 so as to be engaged with the first teeth 11 in the head 10.

A control disk 40 is connected to the pawl 30 and rotatably located on a second surface of the head 10. The pawl 30 has a hole 32 defined in an end thereof and a ring 50 has a protrusion 51 inserted in the hole 32. The ring 50 has a connection notch 52 and the control disk 40 has a tongue 41 extending from an underside thereof so that the tongue 41 is engaged with the connection notch 52.

A fixing ring 60 has threads 61 defined in an inner periphery thereof so as to be threadedly engaged with the threads of the neck 23 of the engaging ring 20. The control disk 40 is located between the head 10 and the fixing ring 60.

Figure 4:
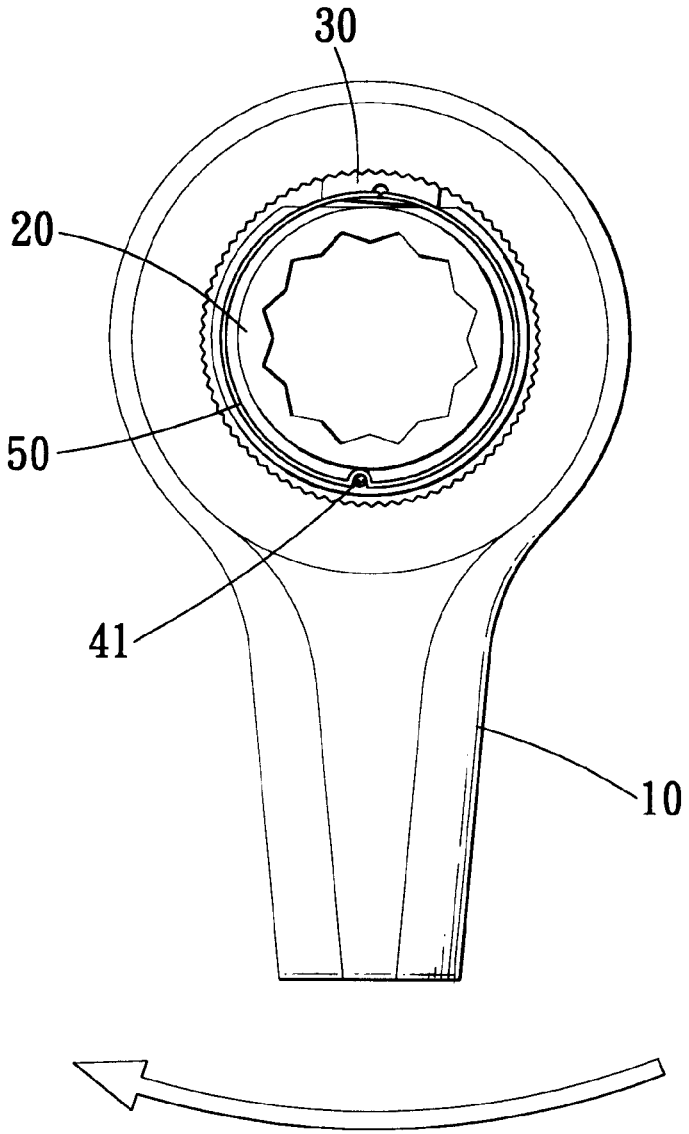
FIG. 4 is a top view to show the pawl is shifted and the wrench is rotated clockwise to output a torque.
Figure 5:
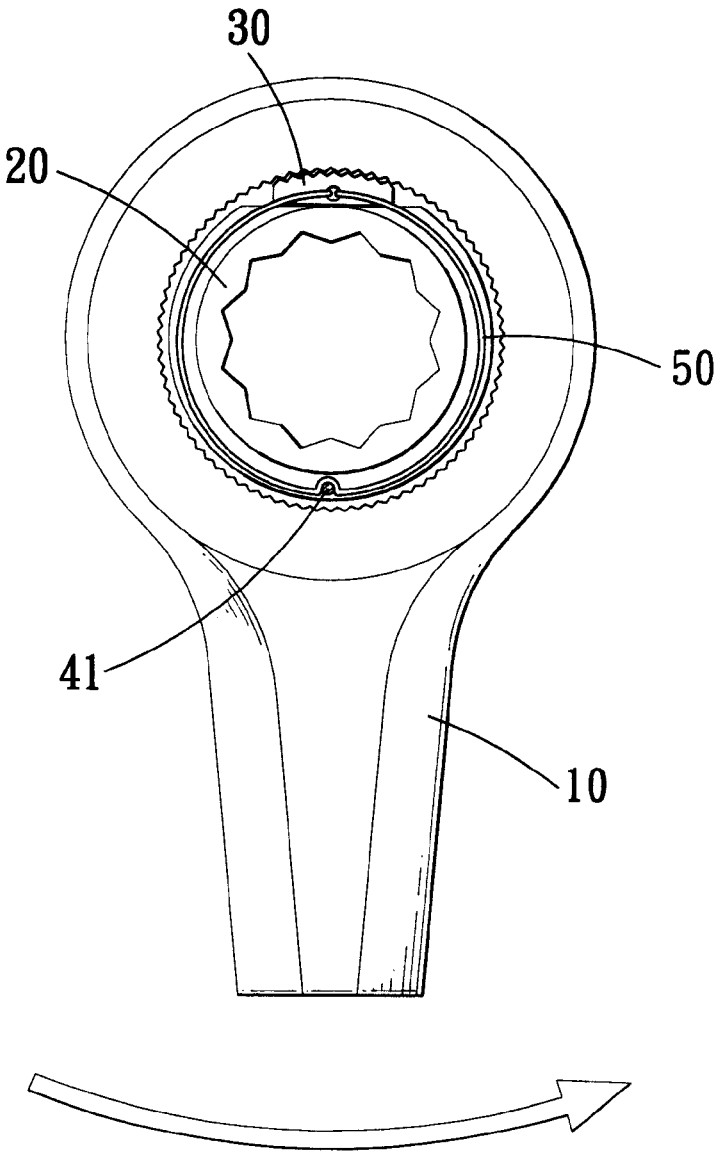
FIG. 5 is a top view to show the wrench is rotated counter clockwise and the pawl moves over the teeth in the head of the wrench.

As shown in FIG. 4, when rotating the control disk 40, the pawl 30 is shifted by the ring 50 connected between the control disk 40 and the pawl 30, the pawl 30 is then engaged with a narrow space between the head 10 and the engaging ring 20. Therefore, the engaging ring 20 is rotated clockwise with the head 10 to output a torque. When the wrench is rotated counter clockwise, the engaging ring 20 is fixed and the head 10 is rotated counter clockwise and the pawl 30 moves over the first teeth 11 in an inner periphery of the head 10.

Figure 6:
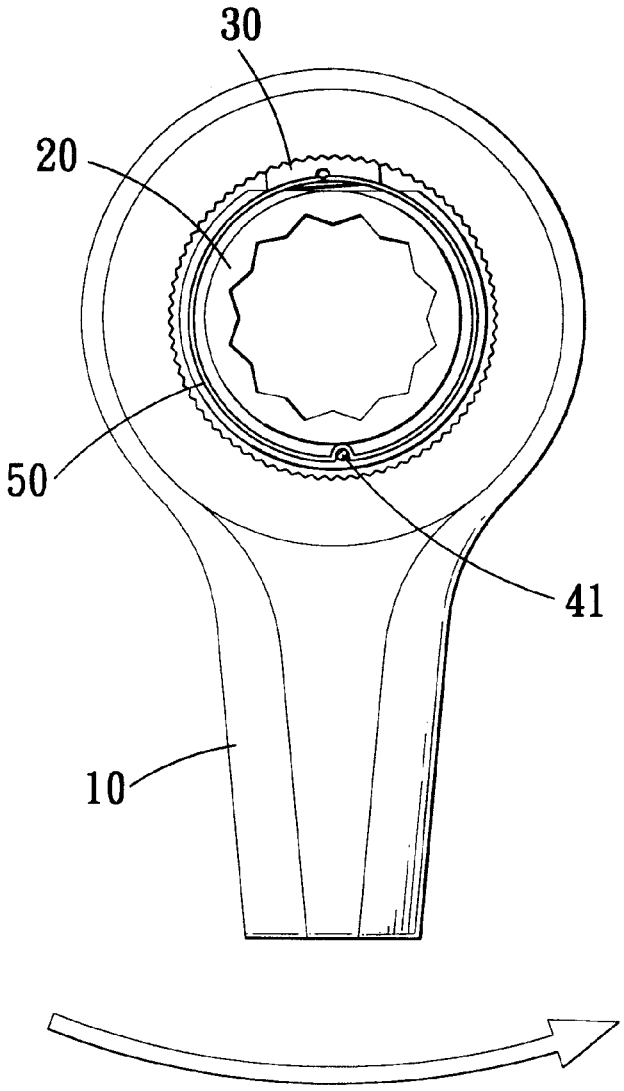
FIG. 6 is a top view to show the pawl is shifted to another position and the wrench is rotated counter clockwise to output a torque.

FIG. 6 shows when the pawl 30 is shifted to the left, when rotating the wrench counter clockwise, the engaging ring 20 is rotated with the head 10 to output a torque.

While we have shown and described the embodiment in accordance with the present invention, it should be clear to those skilled in the art that further embodiments may be made without departing from the scope of the present invention.

What is claimed is:

1. A reversible ratchet wrench comprising:

a ring-shaped head with first teeth defined in an inner periphery of said head;

an engaging ring rotatably received in said head and having a surface defined in an outer periphery of said engaging ring, a neck having threads defined in an outer periphery thereof, and a flange extending radially outward from a second end of said engaging ring so as to engage a first surface of said head;

a polygonal through hole defined through said engaging ring so that an object can be engaged with said polygonal through hole;

a pawl having a hole defined in an end thereof movably engaged with said surface of said engaging ring and having second teeth which are engaged with said first teeth in said head, a control disk being connected to said pawl and rotatably located on a second surface of said head, a ring having a protrusion inserted in said hole of said pawl and having a connection notch, said control disk having a tongue extending from an underside thereof so that said tongue is engaged with said connection notch; and, a fixing ring having threads defined in an inner periphery thereof being threadedly engaged with the threads of said neck of said engaging ring;

wherein, said control disk is located between said head and said fixing ring.

* * * * *